US010068734B2

(12) United States Patent
Metral et al.

(10) Patent No.: US 10,068,734 B2
(45) Date of Patent: Sep. 4, 2018

(54) MICRO-SOLENOID CONTACTOR FOR MOTOR VEHICLE STARTER, AND CORRESPONDING STARTER

(71) Applicant: VALEO EQUIPEMENTS ELECTRIQUES MOTEUR, Creteil (FR)

(72) Inventors: Jean Sébastien Metral, La Verpillière (FR); Tristan Guesney, Lyons (FR)

(73) Assignee: Valeo Equipements Electriques Moteur, Creteil (FR)

( * ) Notice: Subject to any disclaimer, the term of this patent is extended or adjusted under 35 U.S.C. 154(b) by 0 days.

(21) Appl. No.: 15/119,958

(22) PCT Filed: Feb. 19, 2015

(86) PCT No.: PCT/FR2015/050408
§ 371 (c)(1),
(2) Date: Aug. 18, 2016

(87) PCT Pub. No.: WO2015/128564
PCT Pub. Date: Sep. 3, 2015

(65) Prior Publication Data

US 2017/0062164 A1 Mar. 2, 2017

(30) Foreign Application Priority Data

Feb. 27, 2014 (FR) ..... 14 51567

(51) Int. Cl.
*H01H 51/06* (2006.01)
*H01H 47/22* (2006.01)
(Continued)

(52) U.S. Cl.
CPC ..... *H01H 51/065* (2013.01); *H01H 47/22* (2013.01); *H01H 50/20* (2013.01);
(Continued)

(58) Field of Classification Search
CPC ..... H01H 51/065; H01H 47/22; H01H 50/20; H01H 50/42; H01H 2235/01; H01H 51/06
(Continued)

(56) References Cited

U.S. PATENT DOCUMENTS 6,380,831 B1 * 4/2002 Kajino ..... F02N 11/087 335/126
8,416,551 B2 4/2013 Plaideau
(Continued)

FOREIGN PATENT DOCUMENTS

CN 101892933 11/2010
CN 102637555 8/2012
(Continued)

OTHER PUBLICATIONS

Corresponding CN Search Report.

*Primary Examiner* — Bernard Rojas
(74) *Attorney, Agent, or Firm* — Berenato & White, LLC

(57) ABSTRACT

A contact-breaker for a heat engine starter comprises a cap, a micro-solenoid having a coil which is stationary relative to the cap, and a core which is translational relative to the cap between a starting position and an end position. At least two contact terminals are stationary relative to the cap. A contact plate is inside the cap and is movable between a deactivated position in which the contact plate is spaced from the contact terminals and an active position in which the contact plate is in contact with the contact terminals. The contact-breaker is characterized in that the contact plate is secured to the core of the micro-solenoid in such a way that the contact plate drives the core of the micro-solenoid towards the starting position of the core when the contact plate moves from the active position into the deactivated position.

21 Claims, 5 Drawing Sheets

(51) Int. Cl.

| | |
|---|---|
| ***H01H 50/20*** | (2006.01) |
| ***H01H 50/42*** | (2006.01) |
| *H01H 3/60* | (2006.01) |
| *H01H 47/04* | (2006.01) |

(52) U.S. Cl.
CPC ..... *H01H 50/42* (2013.01); *H01H 3/60* (2013.01); *H01H 47/04* (2013.01); *H01H 2235/01* (2013.01)

(58) Field of Classification Search
USPC ..... 335/121–126
See application file for complete search history.

(56) References Cited

U.S. PATENT DOCUMENTS

| | | | | |
|---|---|---|---|---|
| 8,446,238 | B2 | 5/2013 | Plaideau | |
| 8,985,080 | B2 | 3/2015 | Murata et al. | |
| 2012/0206220 | A1 | 8/2012 | Niimi et al. | |
| 2014/0345554 | A1* | 11/2014 | Plaideau | H01H 51/065 123/179.3 |
| 2014/0373801 | A1* | 12/2014 | Metral | H01H 51/065 123/179.3 |

FOREIGN PATENT DOCUMENTS

| | | | | |
|---|---|---|---|---|
| EP | 2385538 | | 11/2011 | |
| EP | 2385539 | | 11/2011 | |
| EP | 2980819 | A1 * | 2/2016 | F02N 11/0844 |
| FR | 2795884 | | 1/2001 | |
| FR | 2923869 | | 5/2009 | |
| FR | 2959891 | | 11/2011 | |
| WO | WO2013093365 | | 6/2013 | |

* cited by examiner

MICRO-SOLENOID CONTACTOR FOR MOTOR VEHICLE STARTER, AND CORRESPONDING STARTER

CROSS-REFERENCE TO RELATED APPLICATIONS AND CLAIM TO PRIORITY

This application is a national stage application of International Application No. PCT/FR2015/050408 filed Feb. 19, 2015, which claims priority to French Patent Application No. 1451567 filed Feb. 27, 2014, the disclosures of which are incorporated herein by reference and to which priority is claimed.

FIELD OF THE INVENTION

The present invention relates to an improved micro-solenoid contactor for a motor vehicle starter, as well as to the corresponding starter. The invention has a particularly advantageous application in the field of electromagnetic contactors for power circuits, in particular for an electric motor of a starter of a thermal engine, in particular of a motor vehicle.

The invention is used in particular with the starters of so-called stop and start systems which make it possible to stop and restart the thermal engine of the vehicle according to the traffic conditions in particular.

BACKGROUND OF THE INVENTION

According to a known design, an electromagnetic contactor for a power circuit comprises a mobile contact which is fitted on a control rod. The mobile contact is designed to come into contact with power terminals which are arranged in a contact chamber. This contactor is used for example in order to control the activation of an electric motor of a starter of an internal combustion engine.

More specifically, an electromagnetic contactor 1 shown in FIGS. 1*a* to 1*c* is provided with a mobile core 3, a fixed core 4 and a metal housing 6, or vessel, in which there are arranged a pull-in coil 81 and a hold-in coil 82 which are fitted on an insulating annular support 9. This support 9 and the front end of the housing 6 are provided centrally with a passage for the mobile core 3.

An end of the mobile core 3 is connected to a pivoting lever (not represented), which acts for example on the launcher of the starter, as described in document FR2795884. This therefore shows the tooth-against-tooth spring 10 which can be compressed in the case of lack of direct penetration of the pinion of the launcher (not represented) into the starter ring which is connected to the thermal engine and the connection rod 12 which is connected to the pivoting lever.

The other end of the mobile core 3 is designed to act on a front end of a control rod 15 by thrusting through a central hole 16 in the fixed core 4, in which the front part of the rod 15 is fitted such as to slide.

The control rod 15 supports a contact plate 21. The contact plate 21 extends transversely relative to the rod 15, in order to cooperate with two electric terminals 26*a*, 26*b* of an electric power circuit, and to establish an electrical contact between them. One of the terminals 26*a* is designed to be connected to a positive terminal of the battery, the other terminal 26*b* being designed to be connected by means of a cable to brushes of the electric motor with positive polarity.

The two terminals 26*a*, 26*b* are secured and supported by a cap 30 made of electrically insulating material which ensures the closure of the rear of the vessel 6. The cap 30 is secured by folding of material of the free end of the vessel 6 back onto the cap 30.

The rod 15 supports an axial compression spring 32 which is arranged between a shoulder 33 of the rod 15 and a face of the mobile contact 21. The contactor 1 also comprises a return spring 38 which is arranged between the cap 30 and a stop of the control rod 15.

In addition, a micro-solenoid 41 is integrated in one of the terminals 26*a*. This micro-solenoid 41 comprises a coil 42 which is secured relative to the 30, and a core 43 which is mobile in translation relative to the cap 30. This core 43 is mobile between an initial position, in which an end of the core 43 projects relative to the terminal 26*a*, such as to prevent electrical contact between the plate 21 and the terminal 26*a*; and a final position in which the core 43 permits electrical contact between the plate 21 and the terminal 26*a*. A return spring 46 is supported firstly against the base of the cap 30, and secondly against an end head of the core 43 which is situated opposite the cap 30. This spring 46 ensures the return of the core 43 to the initial position further to a cut-off of the supply of the micro-solenoid 41. Reference can be made for example to documents FR2923869 or FR2959891 for further details of such a device.

The mobile core 3 is initially in the so-called position of rest, in which the core 3 is spaced from the fixed core 4. The plate 21 is then in a deactivated position in which the plate 21 is spaced from the contact terminals 26*a*, 26*b*. The micro-solenoid 41 is then not supplied with power, and its core 43 is maintained in the initial position by the return spring 46.

Further to a demand by the engine computer, the coils 81 and 82 are activated electrically, and then create a magnetic field. This magnetic field permits the axial displacement of the mobile core 3 in the direction of the fixed core 4. The rear end of the mobile core 3 comes into contact with the front end of the control rod 15, then displaces the rod 15 axially through the hole 16, in the direction of the rear of the contactor 1, until the said mobile core 3 is supported against the fixed core 4 in a so-called magnetised position.

The displacement of the rod 15 has the effect of displacing the plate 21 into a so-called pre-engagement position, in which the plate 21 is in contact with the terminal 26*b*, but is kept spaced from the other terminal 26*a*. For this purpose, power has previously been supplied to the micro-solenoid 41, such that its core 43 can withstand the force applied by the plate 21, and therefore be maintained in the initial position. The compression spring 32 is then compressed.

When a starting demand is issued by the engine computer, the supply to the micro-solenoid 41 is cut off, such that the core 43, which can no longer withstand the force applied by the plate 21, can then go into the final position represented in FIG. 1*c*. The contact plate 21 then establishes contact with the two terminals 26*a*, 26*b*, which makes it possible to supply the electric motor of the starter with power.

The problem consists in the fact that the compression spring 32 has stored mechanical energy such that when the current which passes through the coil 42 of the micro-solenoid 41 is cut off, in order to make the contact plate 21 go from the pre-engagement position to the active position, the core 43 will tend to oscillate between its final position and its initial position, which will generate impacts with the plate 21, and thus a risk of reopening of the electrical contact between the plate 21 and the terminals of the contactor 26*a*, 26*b*.

SUMMARY OF THE INVENTION

The objective of the present invention is to eliminate this disadvantage efficiently by proposing a contactor for a starter of a thermal engine, comprising:

a cap;

a micro-solenoid, comprising a coil which is fixed relative to the said cap, and a core which is mobile in translation relative to the said cap between an initial position and a final position;

at least two contact terminals which are fixed relative to the said cap; and a contact plate which is situated in the interior of the said cap, and can be displaced between a deactivated position in which the said contact plate is spaced from the contact terminals or spaced from at least one contact terminal, and an active position in which the said contact plate is in contact with the two contact terminals, characterised in that the said contact plate is attached to the said core of the said micro-solenoid such that, during the displacement of the said contact plate from the active position to the deactivated position, the said contact plate drives the said core of the said micro-solenoid to its initial position.

The invention thus makes it possible to eliminate the use of the return spring of the core of the micro-solenoid, which reduces the oscillation effect observed during the release of the energy stored by the compression spring when the contact plate goes from the pre-engagement position to the active position.

According to one embodiment, when the coil of the micro-solenoid is supplied electrically, the core is maintained in the initial position.

According to one embodiment, the core in the initial position prevents the contact plate from being in the active position.

According to one embodiment, when the coil of the micro-solenoid is deactivated, and when the contact plate goes from the deactivated position to the active position, the core goes from its initial position to its final position.

According to one embodiment, the core goes from its initial position to its final position by being attracted by a magnet or by means of the small plate which thrusts it, or a resilient element which is compressed in the initial position of the core.

According to one embodiment, the said contactor comprises:

a contact plate which can go from an active position to a deactivated position;

a first terminal which can be connected to a brush of the electric motor, and a second terminal which can be connected to a positive terminal of a supply source, such as a battery; and in the deactivated position, the contact plate is spaced from the first and the second terminal, and in the active position the contact plate connects the two terminals electrically;

when the plate goes from the deactivated position to the active position, and the core of the micro-solenoid is in the initial position, the contact plate is between the deactivated position and the active position, in an intermediate position it is in contact with one of the terminals, for example the second terminal, and is supported on the core of the solenoid split in the initial position.

According to one embodiment, the contactor is configured such that a gap exists between a head of the core of the said micro-solenoid and a face of the said contact plate, when the said core is in the final position. This makes it possible to prevent the end of the core from coming into contact with the plate when the core is in the final position.

According to one embodiment, the contactor is configured such that a gap exists between an intermediate shoulder of the core of the said micro-solenoid and a face of the said contact plate which faces towards the intermediate shoulder when the said core is in the final position. This makes it possible to prevent any rebound of the core when the latter goes from the initial position to the final position from giving rise to an impact between the contact plate and the intermediate shoulder.

According to one embodiment, the contactor comprises a retention device for retention of the core of the micro-solenoid in the final position. A configuration of this type makes it possible to limit the risks of rebounds of the core as far as possible.

According to one embodiment, the retention device comprises a magnet which is positioned at the base of the said cap. This embodiment is particularly simple to produce.

According to one embodiment, a force of a return spring which is positioned between a base of the said cap and a control rod is sufficiently strong to detach the core of the said micro-solenoid from the magnet further to switching off of the said contactor.

According to one embodiment, the retention device comprises a magnetic support in the form of a "U" positioned at the base of the said cap.

According to one embodiment, the contactor is configured to establish a magnetic flux loop which passes via the magnetic support when the said core of the micro-solenoid is in the final position. This therefore creates a magnetic force for retention of the solenoid core in the final position when the plate is in the active position.

According to one embodiment, the contactor comprises a resistor which is fitted between an end of the coil of the micro-solenoid and an end of a pull-in coil. This allows a current to pass through the coil of the solenoid whilst its control switch is open, in order to generate a magnetic force which is sufficient for the retention of the core of the solenoid in the final position.

According to another embodiment, comprising embodiments previously described, when the contact plate is supported against the core in the initial position, the contact plate is in contact with one of the terminals, and when the core goes from its initial position to its final position as a result of the deactivation of the micro-solenoid (the coil of the micro-solenoid is no longer supplied with power), the contact plate pivots, and comes into contact with the other terminal, thus giving rise to the supply to the electric motor of the starter.

The invention also relates to a starter of a thermal engine comprising a contactor as previously described.

BRIEF DESCRIPTION OF THE DRAWINGS

The invention will be better understood by reading the following description and examining the figures which accompany it. These figures are provided purely by way of illustration of the invention which is in no way limiting.

DETAILED DESCRIPTION OF THE PREFERRED EMBODIMENT(S)

In the following description, elements which are identical, similar or analogous retain the same reference from one figure to another, and use will be made of an axial orientation from front to rear corresponding to an orientation from left to right according to FIGS. 2*a*-2*c*, and 5*a*-5*c*.

Figure 1A:
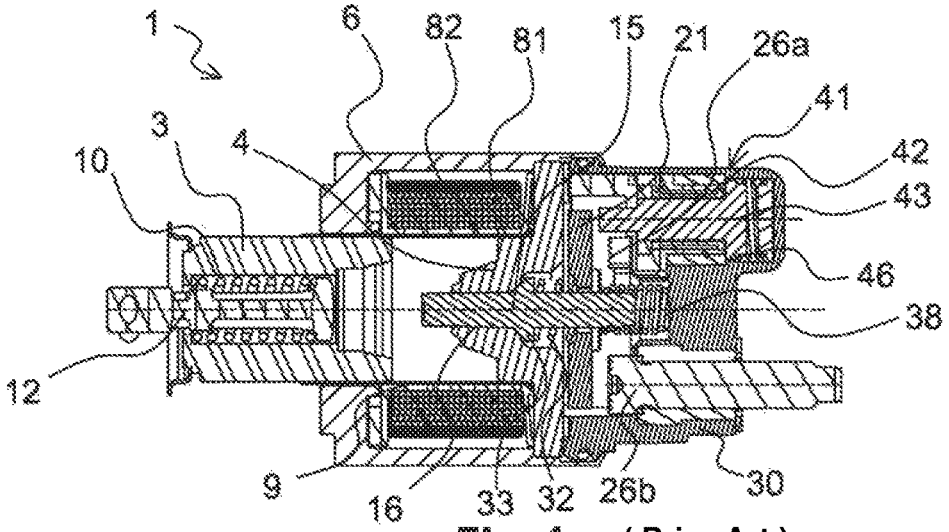
Fig. 1a ( Prior Art )
FIGS. 1*a* to 1*c*, already described, are views in longitudinal cross-section of a contactor according to the prior art, respectively in a state of rest, a state of pre-engagement, and in an active state.
Figure 1B:
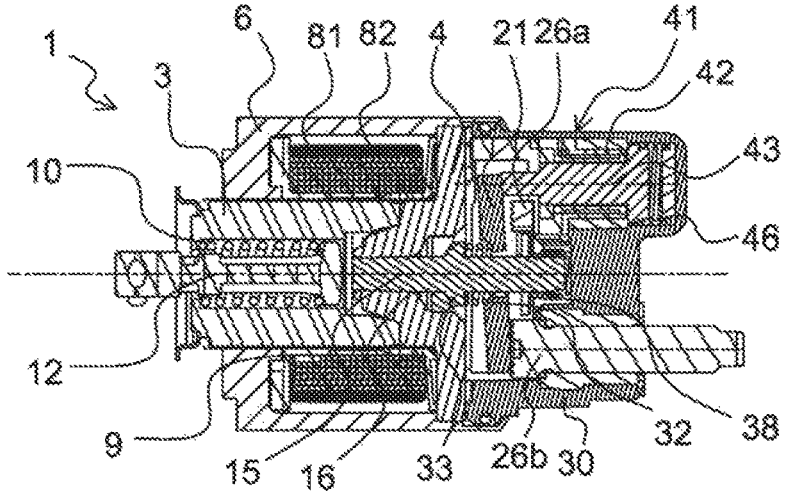
Fig. 1b ( Prior Art )
Figure 1C:
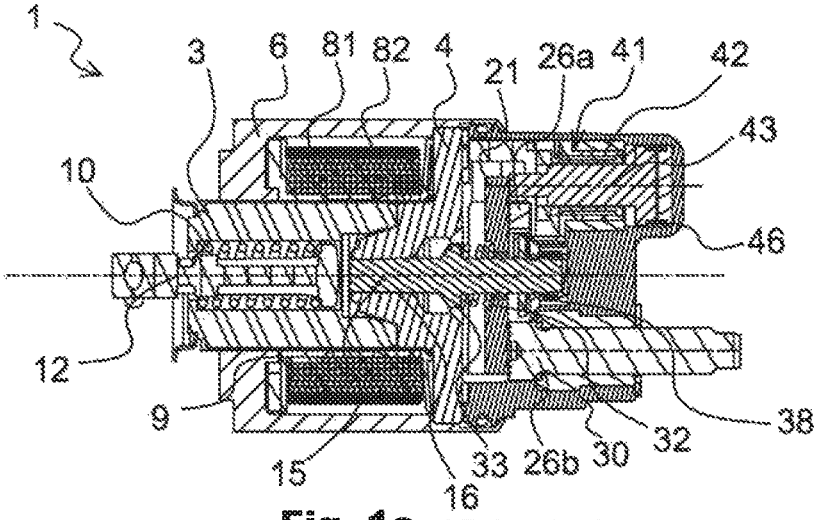
Fig. 1c ( Prior Art )
Figure 2A:
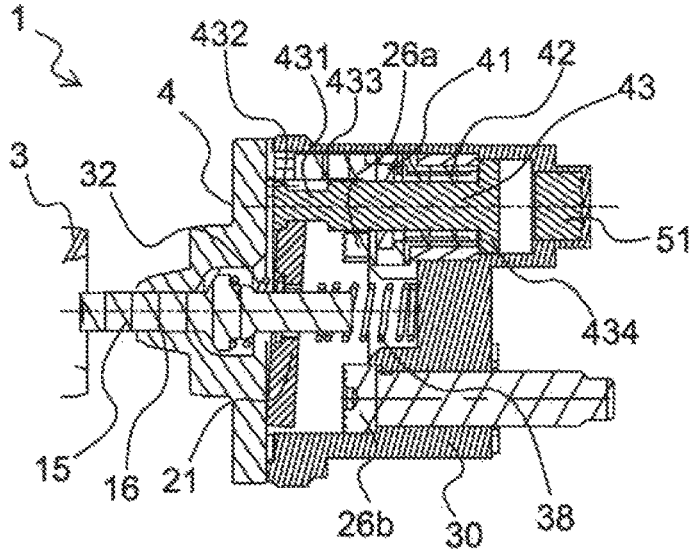
FIGS. 2*a* to 2*c* are views in longitudinal cross-section of a first embodiment of a contactor according to the invention, respectively in a state of rest, a state of pre-engagement, and in an active state which permits starting of the electric motor.
Figure 2B:
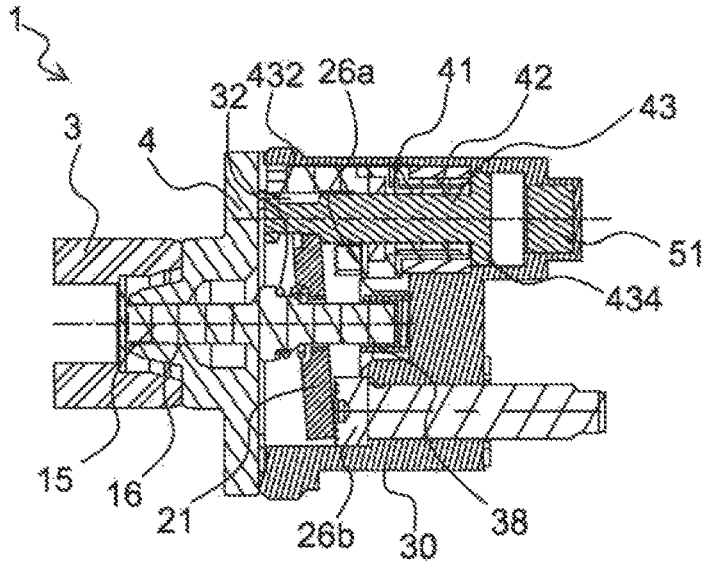
Figure 2C:
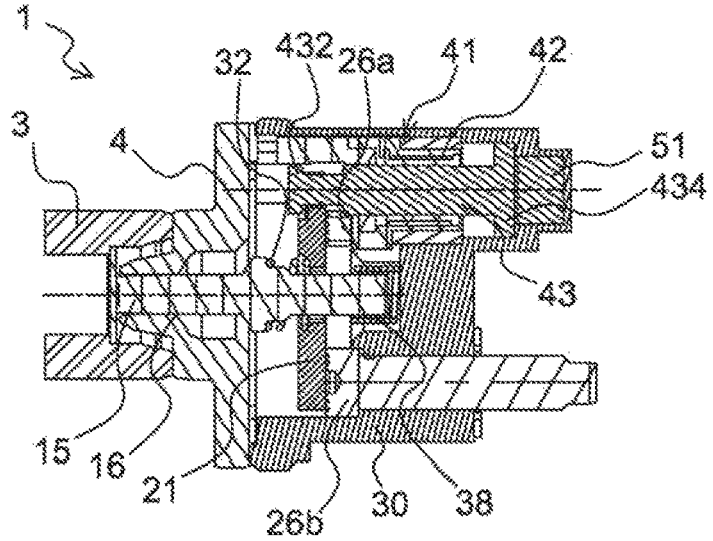

FIGS. 2*a* to 2*c* illustrate a contactor 1 fitted in the place of, and instead of, the contactor in FIGS. 1*a* to 1*c*. This contactor 1 is used for example in order to control the activation of an electric motor of a starter of an internal combustion engine.

This electromagnetic contactor 1 is provided with a mobile core 3, a fixed core 4 and a metal housing 6, or vessel, in which there is provided a pull-in coil and a hold-in coil fitted on an insulating annular support. This support and the front end of the housing are provided centrally with a passage for the mobile core 3. These elements, which are not represented in FIGS. 2*a*-2*c*, in order to simplify the representation, are the same as those represented in FIGS. 1*a* to 1*c* (cf. elements 81, 82 and 9).

An end of the mobile core 3 is connected to a pivoting lever (not represented) which acts for example on the launcher of the starter, as described in document FR2795884. Although not represented, the starter additionally comprises a tooth-against-tooth spring which can be compressed in the event of lack of direct penetration of the pinion of the launcher (not represented) in the starter ring which is connected to the thermal engine, as well as a connection rod which is connected to the pivoting lever, as in the embodiment in FIGS. 1*a* to 1*c*.

The other end of the mobile core 3 is designed to act on a front end of a control rod 15, by thrusting through a central hole 16 in the fixed core 4 in which the front part of the rod 15 is fitted such as to slide.

The control rod 15 supports a contact plate 21. The contact plate 21 extends transversely relative to the rod 15 in order to cooperate with two electrical terminals 26*a*, 26*b* of an electric power circuit, and to establish an electrical contact between them. One of the terminals 26*a* is designed to be connected to a positive terminal of the battery, the other terminal 26*b* being designed to be connected by means of a cable to brushes of the electric motor with positive polarity.

The two terminals 26*a*, 26*b* are fixed, and are supported by a cap 30 made of electrically insulating material which ensures the closure of the rear of the vessel 6. The cap 30 is secured by folding material of the free end of the vessel back onto the cap 30.

The rod 15 supports an axial compression spring 32 which is arranged between a shoulder 33 of the control rod 15 and a face of the mobile contact 21. The contactor 1 also comprises a return spring 38 which is arranged between the cap 30 and a stop of the control rod 15.

In addition, a micro-solenoid 41 which is integrated in the terminal 26*a* comprises a coil 42 which is fixed relative to the cap 30, and a core 43 which is mobile in translation (i.e., axially moveable) relative to the cap 30. The core 43 is positioned in the opening which is delimited by the coil 42. The core 43 is mobile between an initial position, in which an end of the core 43 projects relative to the terminal 26*a*, such as to prevent electrical contact between the plate 21 and the terminal 26*a*; and a final position in which the core 43 permits electrical contact between the plate 21 and the terminal 26*a*.

The contact plate 21 is attached to the core 43 such that, during the displacement of the contact plate 21 from the active position to the deactivated position, the contact plate 21 drives the core 43 to its initial position. Moreover, the contact plate 21 is moveable relative to the core 43.

For this purpose, as can be seen clearly in FIG. 2*a*, the plate 21 is fitted via an opening in a portion 431 with a reduced cross-section of the core 43. This portion is delimited axially by a head 432 of the core 43 which is situated on the fixed core 4 side, as well as an intermediate shoulder 433 which is situated between the two end heads 432, 434 of the core 43. The plate 21 has an opening with a diameter which is substantially equal to the diameter of the portion with a reduced cross-section, but smaller than the diameter of the end head 432 and the intermediate shoulder 433. This shoulder 433 is defined by a difference in diameter of the core 43.

The production can take place for example by inserting the portion 433 which is still without the head 432 into the opening in the contact plate 21, then, the end of the portion 433 is deformed by compression, thus forming the head 432.

According to another embodiment, the head 432 and the opening in the plate are formed such as to be able to be fitted in bayonet form. In other words, the head 432 is for example rectangular and the opening is also rectangular such as, during the assembly, to be able to insert the head then the portion 433 of the core 43 in the plate via the opening, then rotate the core 43 by 90° relative to the plate, such that the head in the form of a rectangle can no longer pass through the opening in the form of a rectangle.

According to another production embodiment, the head 432 is a washer which is secured on the portion 433, for example by means of clamped fitting, adhesion, or welding.

The contactor 1 additionally comprises a magnet 51 which is positioned in the base of the cap 30, in order to ensure retention of the core 43 of the micro-solenoid 41 when the latter is in the final position, in order to limit as far as possible the risks of rebounds of the core 43. The force of the return spring 38 is strong enough to detach the core 43 from the magnet 51 when the power of the pull-in coils and hold in coils is switched off.

When the contact plate thrusts the core in the direction of its final position, and the coil of the micro-solenoid is deactivated, the core is displaced from its initial position to its final position. The core can finish its course by being attracted by a magnet or by means of the small plate which thrusts it, or a resilient element which is compressed in the initial position of the core.

As shown in FIG. 2*a*, the mobile core 3 is initially in a so-called position of rest, in which the core 3 is spaced from the fixed core 4. The plate 21 is then in a deactivated position, in which the plate 21 is spaced from the contact terminals 26*a*, 26*b*. The micro-solenoid 41 is not supplied with power. The core 43 is maintained in the initial position by the contact plate 21 which draws on the head 432 of the core 43, whereas the head 434 opposite is supported against an end of the coil 42.

Further to a demand by the engine computer, the pull-in coil as well as the hold-in coil are activated electrically, and then create a magnetic field. This magnetic field permits the axial displacement of the mobile core 3 in the direction of the fixed core 4, as shown in FIG. 2*b*. The rear end of the mobile core 3 comes into contact with the front end of the control rod 15, then displaces the rod 15 axially through the hole 16 in the direction of the rear of the contactor 1, until the said mobile core 3 is supported against the fixed core 4 in a so-called magnetised position.

The displacement of the rod 15 has the effect of displacing the plate 21 into a position, known as the pre-engagement position, in which the plate 21 is in contact with the terminal 26*b*, but is kept spaced from the other terminal 26*a*. For this purpose, power has previously been supplied to the micro-solenoid 41, such that the core 43 can withstand the force applied by the plate 21 supported against the intermediate shoulder 433. The core 43 is thus maintained in the initial position. The return spring 38 and the compression spring 32 are moreover compressed.

When a starting demand is issued by the engine computer, the supply to the micro-solenoid 41 is cut off, such that the core 43, which can no longer withstand the force applied by the plate 21, can then go into the final position represented in FIG. 2*c*. The contact plate 21 then establishes a contact with the two terminals 26*a*, 26*b* (active position), which makes it possible to supply the electric motor of the starter with power.

It will be noted that a gap preferably exists between the head 432 of the core 43, which head faces the fixed core 4 side, and a face of the plate 21, when the core 43 is in the final position. This makes it possible to prevent the head 432 of the core from coming into contact with the plate 21 when the core 43 is in the final position.

A gap also exists between the intermediate shoulder 433 of the core 43 of the micro-solenoid 41 and a face of the contact plate 21 which faces towards the said intermediate shoulder 433. This makes it possible to prevent any rebound of the core 43 when the latter goes from the initial position to the final position from giving rise to an impact between the plate 21 and the intermediate shoulder 433.

When the power of the coils 81 and 82 is switched off, the mobile core 3 is no longer attracted towards the fixed core 4, which gives rise to a return of the mobile core 3 to the position of rest, via the action of a spring which is positioned between the vessel 6 and an end of the mobile core 3. The axial compression spring 32 then the return spring 38 are decompressed and thrust the control rod 15, which has the effect of spacing the contact plate 21 from the terminals 26*a*, 26*b*. The core 43 is then detached from the magnet 51, and is driven by the contact plate 21 to its initial position. The displacement of the core 43 is limited by the head 434 which abuts the coil 42. The contact plate 21 then goes from the active position to the deactivated position.

Figure 4A:
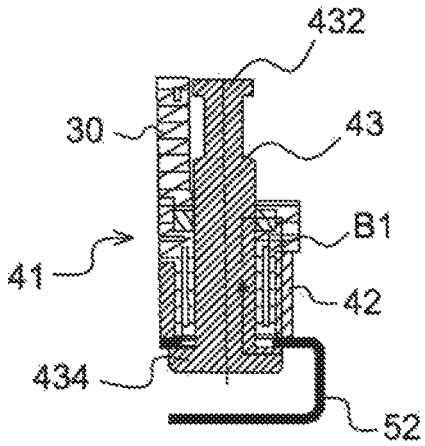
FIGS. 4*a* and 4*b* are schematic representations of the flux generated by the micro-solenoid, respectively when the switch Int_comm_2 of the circuit in FIG. 3 is in the active state and in the deactivated state.
Figure 4B:
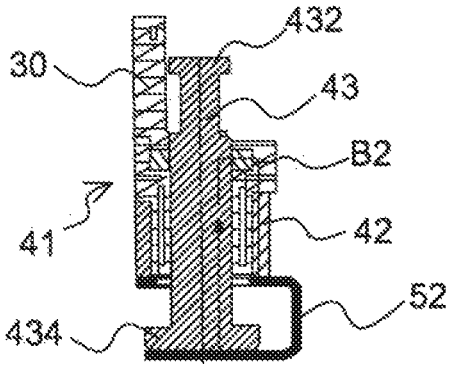

Alternatively, as represented in FIGS. 4*a* and 4*b*, the magnet 51 is replaced by a magnetic support 52 in the form of a "U" positioned at the base of the cap 30. The support 52 is configured to establish a magnetic flux loop B2 which passes via the core 43 and the magnetic support 52, when the core 43 is in the final position.

Figure 3:
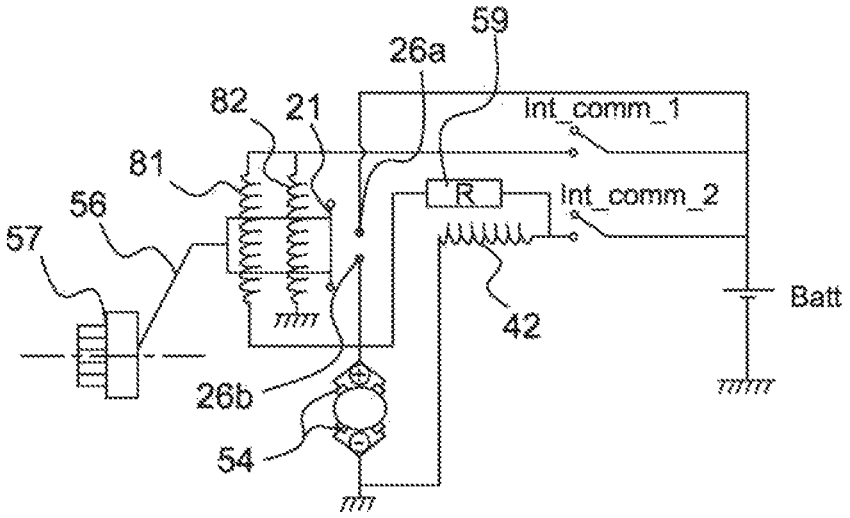
FIG. 3 is a schematic representation of an electrical control circuit of the starter according to the present invention.

FIG. 3 represents a control wiring diagram of the starter which makes it possible to generate the magnetic attraction force of the core 43 when the latter is in the final position.

More specifically, the terminal 26*a* is connected to the positive terminal of the battery Batt, whereas the other terminal 26*b* is connected to the brushes with positive polarity via a cable. The contact plate 21 can establish a contact between these two terminals 26*a*, 26*b*, as previously explained. The brushes 54 with negative polarity are connected to the earth of the starter. The references 56 and 57 correspond respectively to the control lever and to the driver of the starter.

The pull-in coil and the hold-in coil are connected to one another in parallel, and are connected to the positive terminal of the battery Batt by means of a first control switch Int_comm_1. In addition, the coil 42 of the micro-solenoid is connected firstly to the earth, and secondly to the positive terminal of the battery Batt by means of a second control switch Int_comm_2.

A resistor 59 is fitted between an end of the coil 42 of the micro-solenoid (the one situated on the Int_comm_2 switch side) and an end of the pull-in coil.

When the two control switches Int_comm_1 and Int_comm_2 are activated, the micro-solenoid 41 is supplied with power and blocks the plate 21 in the pre-engagement position. The coil 42 then generates a flux loop B1 which passes via the core 43, but not via the support 52 from which the core 43 is spaced.

When the Int_comm_2 control of the micro-solenoid 41 is released (or in the case of direct starting), the micro-solenoid 41 is supplied by the pull-in coil, via the resistor 59. The micro-solenoid 41 then does not make it possible to generate enough force to block the plate 21, such that the plate 21 goes into the active position, and the core 43 goes into the final position. Once the core 43 is in the final position, the coil 42 of the micro-solenoid continues to be supplied with power via the coil 81 and the resistor 59. The coil 42 then generates a magnetic flux loop B2 which passes via the magnetic support 52 and the core 43, which makes it possible to maintain the core 43 of the micro-solenoid 41 at the base of the cap 30. The attraction force is low, because of the reduced intensity of supply of the coil 42 and the configuration of the magnetic circuit.

When the two controls Int_comm_1 and Int_comm_2 are cut off, no further current passes into the coil 42, which then no longer generates any attraction force. The core 43 is then driven by the contact plate 21 into the initial position, and is displaced by the control rod 15 during the decompression of the return spring 38.

It should be noted that an embodiment of this type can also be applied to the contactor in FIGS. 1*a* to 1*c*, in which the core 43 of the micro-solenoid has a conventional form, and a return spring 46 is fitted between the base of the cap 30 and the end head of the core 43. In this case, when the core 43 is in the final position, the control Int_comm_2 is released, and the control Int_comm_1 is activated, the magnetisation force which is generated by the flux loop B2 must be greater than the force exerted by the return spring 46, which is then compressed. This makes it possible to avoid rebounds of the core 43 during its passage from the initial position to the final position.

Figure 5A:
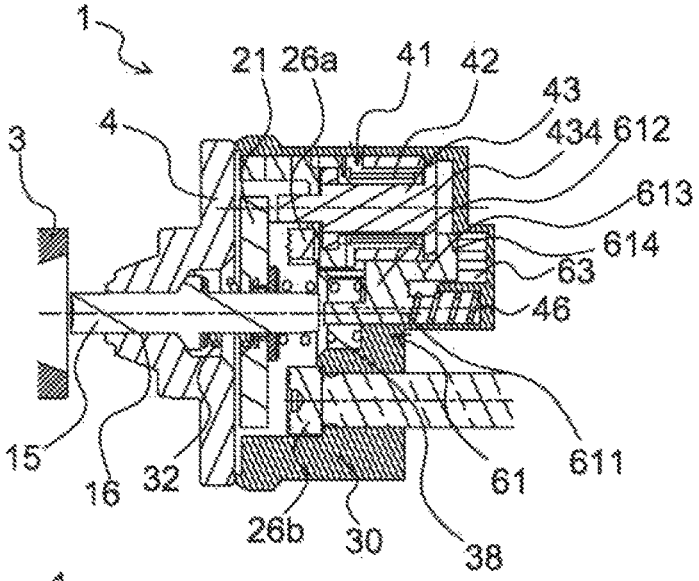
FIGS. 5*a* to 5*c* are views in longitudinal cross-section of a second embodiment of a contactor according to the invention, provided with an intermediate part, respectively in a state of rest, a state of pre-engagement, and in an active state.
Figure 5B:
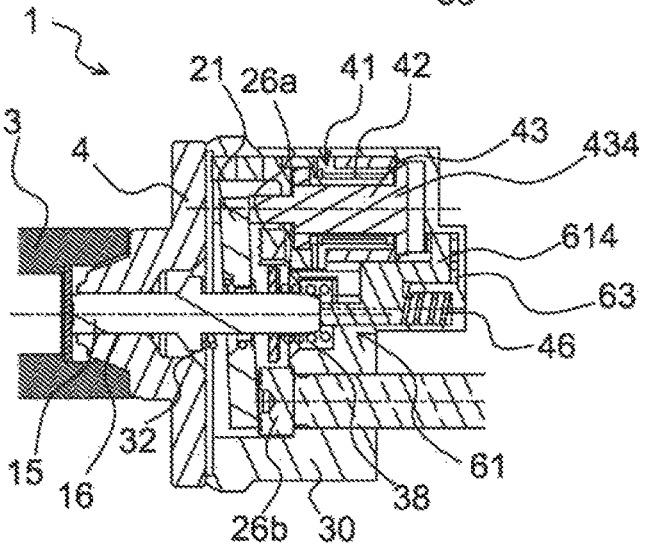
Figure 5C:
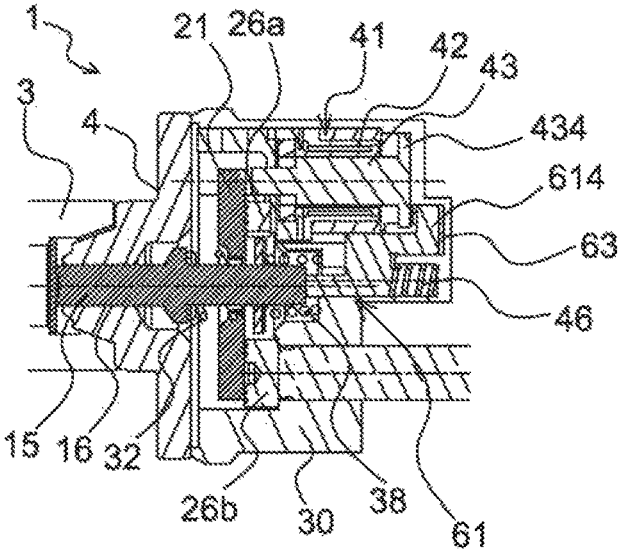

In the embodiment in FIGS. 5*a* to 5*c*, the contactor 1 comprises an intermediate part 61 which is fitted between a return spring 46 and the control rod 15. In addition, the return spring 38 is positioned between the stop of the control rod 15 and the cap 30. The intermediate part 61 is configured to raise the core 43 from the micro-solenoid 41 from the final position to the initial position.

For this purpose, the intermediate part 61 comprises a first portion 611 which extends axially forwards and is positioned between the return spring 46 of the core 43 and the rear end of the control rod 15. A second, median portion 612 extends radially from the rear end of the first portion 611 in the direction of the core 43 of the micro-solenoid 41. A third portion 613 extends axially rearwards from a rear face of the median part 612. A fourth portion 614 extends radially in the direction of the core 43.

As shown in FIG. 5*a*, the mobile core 3 is initially in a so-called position of rest, in which the core 3 is spaced from the fixed core 4. The plate 21 is then in a deactivated position, in which the plate 21 is spaced from the contact terminals 26*a*, 26*b*. Power is not supplied to the micro-solenoid 41. The core 43 is maintained in the initial position by the intermediate part 61 which is thrust by the return spring 46. In fact, the intermediate part 61 is then supported, via a front face of the fourth portion 614, against the head 434 of the core 43 which abuts an end of the coil 42. The intermediate part 61 is then in a so-called initial position.

Further to a demand by the engine computer, the pull-in coil as well as the hold-in coil are activated electrically, and then create a magnetic field. This magnetic field permits the axial displacement of the mobile core 3 in the direction of the fixed core 4. The rear end of the mobile core 3 comes into contact with the front end of the control rod 15, then displaces the rod 15 axially through the hole 16 in the direction of the rear of the contactor 1, until the said mobile core 3 is supported against the fixed core 4 in a so-called magnetised position, as shown in FIG. 5*b*. The displacement rearwards of the rod 15 has the effect of displacing the intermediate part 61 rearwards into a final position, in which the intermediate part 61 is situated spaced from the head 434 of the core 43, which releases the core 43. The fourth portion 614 of the intermediate part 61 is then situated in a recess 63 provided in the cap 30. The return spring 38 of the control rod 15, as well as the return spring 46 of the core 43 of the micro-solenoid 41, are then compressed.

The displacement of the rod 15 also generates the displacement of the plate 21 from the deactivated position to the pre-engagement position, in which the plate 21 is in contact with the terminal 26*b*, but is also kept spaced from the other terminal 26*a*. For this purpose, power has previously been supplied to the micro-solenoid 41, such that the core 43 which is maintained in the initial position can withstand the force applied by the plate 21 supported against an end of the core 43 opposite the head 434. The compression spring 32 is also compressed as a result of pressing of the plate 21 against the terminal 26*b*. With the intermediate part 61 in the final position, the coil 42 alone thus keeps the core 43 in the initial position.

When a starting demand is issued by the engine computer, the supply to the micro-solenoid 41 is cut off, such that the core 43, which no longer withstands the force applied by the plate 21, can then go into the final position represented in FIG. 5*c*. The contact plate 21 thus establishes a contact with the two terminals 26*a*, 26*b* (active position), which makes it possible to supply power to the electric motor of the starter. Since the intermediate part 61 is spaced from the head 434, the return spring 46 does not generate return energy, which prevents reopening of contact between the plate 21 and the terminals 26*a*, 26*b*. The core 43 is then free to be displaced between the contact plate 21 and the base of the cap 30.

When the power to the pull-in coil and hold-in coil is switched off, the mobile core 3 is no longer attracted towards the fixed core 4, which gives rise to a return of the mobile core 3 into the position of rest, via the action of a spring which is positioned between the vessel 6 and an end of the mobile core 3.

The axial compression spring 32 then the return spring 38 are decompressed, which has the effect of spacing the contact plate 21 from the terminals 26*a*, 26*b*. In addition, the decompression of the return spring 46 makes the intermediate part 61 go from the final position to the initial position. During this displacement, the intermediate part 61 is supported on the core 43, in order to make it also go from the final position to the initial position, as well as then to keep it in this initial position by means of the action of the spring 46. The displacement of the core 43 is limited by the head 434 which abuts the coil 42. The contact plate 21 then goes from the active position to the deactivated position.

As in the first embodiment, it will be appreciated that it is possible to use a retention device for retention of the core 43 which takes the form of a magnet 51 or a magnetic support 52 in the form of a "U", in order to limit untimely displacements of the core 43 when it is in the final position.

Figure 6A:
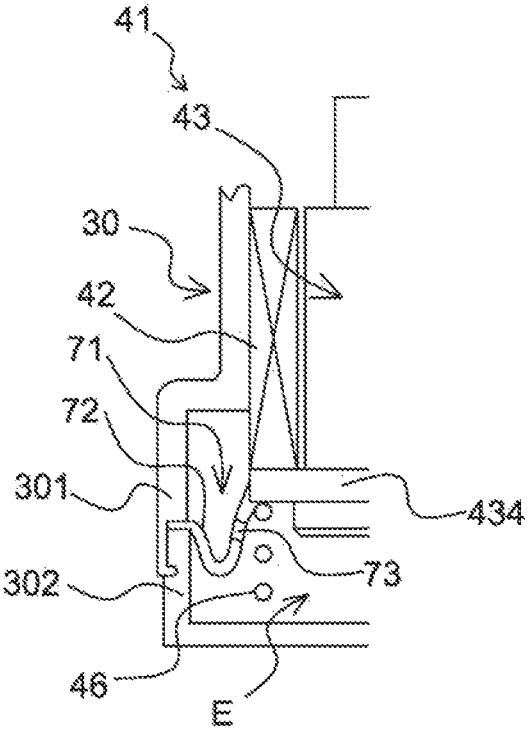
FIGS. 6*a* and 6*b* show partial views in cross-section of a third embodiment of a contactor according to the invention provided with a pneumatic damping device, respectively when the core of the micro-solenoid is in an initial position and in a final position.
Figure 6B:
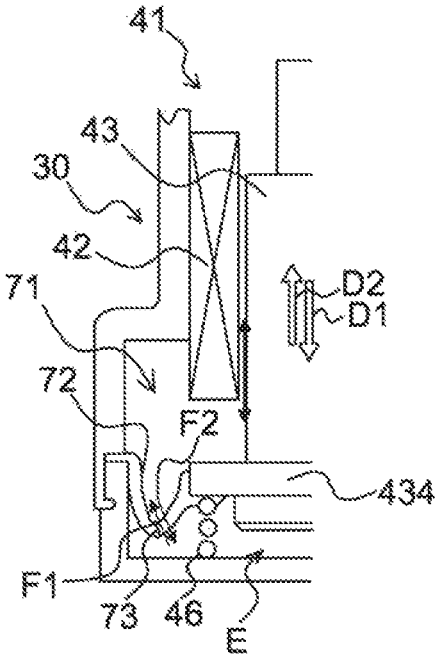

FIGS. 6*a* and 6*b* show a variant embodiment, in which the contactor 1 comprises a device 71 for pneumatic damping of the displacement of the core 43 of the micro-solenoid. In this case, as in the embodiment in FIGS. 1*a* to 1*c*, the contactor 1 comprises a return spring 46 which is positioned between the base of the cap 30 and the head 434 with radial extension which forms a stop of the core 43.

More specifically, the damping device 71 comprises a membrane 72 provided with through openings 73. In this case, the membrane 72 extends between an outer periphery of the core 43 and an inner wall of the cap 30. The membrane 72 is maintained wedged between two parts 301, 302 which form the cap 30. The membrane 72 is thus maintained wedged in the location of the area of snapping together of the two parts 301, 302. In addition, the membrane 72 is glued or preferably over-moulded on an outer periphery of the core 43.

The membrane 72 has openings 73 with dimensions which vary according to a direction of the flow of air F1, F2 generated by a displacement of the core 43 of the micro-solenoid 41. The openings 73 have a larger diameter when the flow of air F1 is directed through the openings 73 from the interior towards the exterior of a space E which is delimited by the membrane 72 and the base of the cap 30, than when the flow of air F2 is directed through the openings 73 from the exterior to the interior of the said space E.

Figure 7:
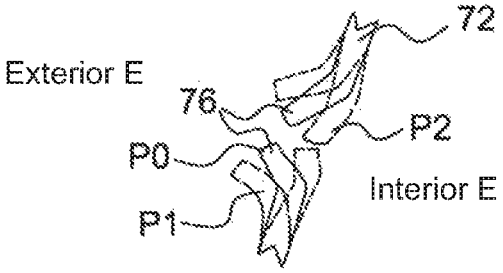
FIG. 7 is a detailed view of the openings in the membrane of the damping device in FIGS. 6*a* and 6*b*.

For this purpose, as illustrated in FIG. 7, the openings 73 in the membrane 72 are delimited by lips 76 which are curved towards the exterior of the space when the device 71 is in the state of rest. The lips 76 are then situated in the position P0.

Thus, when the flow of air F1 which is generated by a displacement D1 of the core 43 in the direction of the base of the cap 30 passes through the openings 73, going from the interior towards the exterior of the space E, this has the effect of accentuating the spacing of the lips 76, such as to maximise the openings 73, and thus facilitate the flow of air output. The lips 76 are then in the position P1. The damping of the core 43 is then slight.

On the contrary, when the flow of air F2 which is generated by a displacement D2 of the core 43 in the direction of the plate 21 passes through the openings 73 going from the exterior towards the interior of the space E, this has the effect of drawing the lips 76 towards one another such as to reduce the openings 73, and therefore oppose the incoming flow of air. The lips 76 are then in the position P2. The damping of the core 43 is then substantial. This therefore limits the speed of displacement of the core 43 when the latter is displaced in the direction of the plate 21, in order to prevent reopening of the contact between the plate 21 and the terminals 26*a*, 26*b*.

It will be appreciated that the foregoing description does not limit the invention, and it would not constitute a departure from the invention to replace the details of execution by others which are equivalent.

The invention claimed is:

1. A contactor (1) for a starter of a thermal engine, comprising:

a cap (30);

a micro-solenoid (41) comprising a coil (42) fixed relative to the cap (30), and a core (43) mobile in translation relative to the cap (30) between an initial position and a final position;

at least two contact terminals (26*a*, 26*b*) fixed relative to the cap (30); and a contact plate (21) situated in the interior of the cap (30), and configured to be displaced between a deactivated position in which the contact plate (21) is spaced from the contact terminals (26*a*, 26*b*) or spaced from at least one contact terminal (26*a*, 26*b*), and an active position in which the contact plate (21) is in contact with the two contact terminals (26*a*, 26*b*), the contact plate (21) is attached to the core (43) of the micro-solenoid (41) such that, during the displacement of the contact plate (21) from the active position to the deactivated position, the contact plate (21) drives the core (43) of the micro-solenoid (41) to the initial position.

2. The contactor according to claim 1, wherein, when the coil of the micro-solenoid is supplied electrically, the core is maintained in the initial position.

3. The contactor according to claim 2, wherein the core in the initial position prevents the contact plate from being in the active position.

4. The contactor according to claim 2, wherein the micro-solenoid is arranged such that, when the coil of the micro-solenoid is deactivated, and when the contact plate goes from the deactivated position to the active position, the core goes from the initial position to the final position.

5. The contactor according to claim 2, wherein the core goes from the initial position to the final position by being attracted by one of a magnet, a small plate which thrusts it, and a resilient element which is compressed in the initial position of the core.

6. The contactor according to claim 1, wherein the core in the initial position prevents the contact plate from being in the active position.

7. The contactor according to claim 6, wherein the micro-solenoid is arranged such that, when the coil of the micro-solenoid is deactivated, and when the contact plate goes from the deactivated position to the active position, the core goes from the initial position to the final position.

8. The contactor according to claim 6, wherein the core goes from the initial position to the final position by being attracted by one of a magnet, a small plate which thrusts it, and a resilient element which is compressed in the initial position of the core.

9. The contactor according to claim 1, wherein the micro-solenoid is arranged such that, when the coil of the micro-solenoid is deactivated, and when the contact plate goes from the deactivated position to the active position, the core goes from the initial position to the final position.

10. The contactor according to claim 9, wherein the core goes from the initial position to the final position by being attracted by one of a magnet, a small plate which thrusts it, and a resilient element which is compressed in the initial position of the core.

11. The contactor according to claim 1, wherein the core goes from the initial position to the final position by being attracted by one of a magnet, a small plate which thrusts it, and a resilient element which is compressed in the initial position of the core.

12. The contactor according to claim 1, wherein the contactor is configured such that a gap exists between a head (432) of the core (43) of the micro-solenoid (41) and a face of the contact plate (21), when the core (43) is in the final position.

13. The contactor according to claim 1, wherein the contactor is configured such that a gap exists between an intermediate shoulder (433) of the core (43) of the micro-solenoid (41) and a face of the contact plate (21) which faces towards the intermediate shoulder (433) when the core (43) is in the final position.

14. The contactor according to claim 1, further comprising a retention device for retention of the core (43) of the micro-solenoid (41) in the final position.

15. A starter of a thermal engine comprising a contactor (1) defined according to claim 1.

16. The contactor according to claim 1, wherein the contact plate (21) is moveable relative to the core (43) of the micro-solenoid (41).

17. A contactor for a starter of a thermal engine, comprising:

a cap (30);

a micro-solenoid (41) comprising a coil (42) fixed relative to the cap (30), and a core (43) mobile in translation relative to the cap (30) between an initial position and a final position;

at least two contact terminals (26*a*, 26*b*) fixed relative to the cap (30); and a contact plate (21) situated in the interior of the cap (30), and configured to be displaced between a deactivated position in which the contact plate (21) is spaced from the contact terminals (26*a*, 26*b*) or spaced from at least one contact terminal (26*a*, 26*b*), and an active position in which the contact plate (21) is in contact with the two contact terminals (26*a*, 26*b*);

the contact plate (21) is attached to the core (43) of the micro-solenoid (41) such that, during the displacement of the contact plate (21) from the active position to the deactivated position, the contact plate (21) drives the core (43) of the micro-solenoid (41) to the initial position; and a retention device operably associated with the core for retention of the core (43) of the micro-solenoid (41) in the final position, the retention device comprising a magnet (51) positioned at the base of the cap (30).

18. The contactor according to claim 17, wherein a force of a return spring (38) positioned between a base of the cap (30) and a control rod (15) is sufficiently strong to detach the core (43) of the micro-solenoid (41) from the magnet (51) further for switching off of the contactor (1).

19. A contactor for a starter of a thermal engine, comprising:

a cap (30);

a micro-solenoid (41) comprising a coil (42) fixed relative to the cap (30), and a core (43) mobile in translation relative to the cap (30) between an initial position and a final position;

at least two contact terminals (26*a*, 26*b*) fixed relative to the cap (30); and a contact plate (21) situated in the interior of the cap (30), and configured to be displaced between a deactivated position in which the contact plate (21) is spaced from the contact terminals (26*a*, 26*b*) or spaced from at least one contact terminal (26*a*, 26*b*), and an active position in which the contact plate (21) is in contact with the two contact terminals (26*a*, 26*b*);

the contact plate (21) is attached to the core (43) of the micro-solenoid (41) such that, during the displacement of the contact plate (21) from the active position to the deactivated position, the contact plate (21) drives the core (43) of the micro-solenoid (41) to the initial position; and a retention device operably associated with the core for retention of the core (43) of the micro-solenoid (41) in the final position, the retention device comprising a magnetic support (52) in the form of a "U" positioned at the base of the cap (30).

20. The contactor according to claim 19, configured to establish a magnetic flux loop which passes via the magnetic support (52) when the core (43) of the micro-solenoid (41) is in the final position.

21. The contactor according to claim 19, further comprising a resistor which is fitted between an end of the coil (42) of the micro-solenoid (41) and an end of a pull-in coil (81).

* * * * *